US007604125B2

(12) United States Patent
Cheng et al.

(10) Patent No.: US 7,604,125 B2
(45) Date of Patent: Oct. 20, 2009

(54) PACKAGING CUSHION DEVICE HAVING MODULAR CUSHION UNITS

(75) Inventors: Sheng-Hsiung Cheng, Taipei Hsien (TW); Te-An Lin, Taipei Hsien (TW); Wu-Nan Wang, Taipei Hsien (TW); Chia-Chia Huang, Taipei Hsien (TW)

(73) Assignee: Aopen Inc., Taipei Hsien (TW)

( * ) Notice: Subject to any disclaimer, the term of this patent is extended or adjusted under 35 U.S.C. 154(b) by 247 days.

(21) Appl. No.: 11/894,868

(22) Filed: Aug. 21, 2007

(65) Prior Publication Data

US 2008/0053866 A1 Mar. 6, 2008

(30) Foreign Application Priority Data

Aug. 29, 2006 (TW) ..... 95131755 A

(51) Int. Cl.
*B65D 81/02* (2006.01)
*B65D 85/30* (2006.01)

(52) U.S. Cl. ..... 206/586; 206/577; 206/320

(58) Field of Classification Search ..... 206/592, 206/525.1, 587, 585, 523, 218, 546, 577, 206/586, 723, 320, 453, 507
See application file for complete search history.

(56) References Cited

U.S. PATENT DOCUMENTS

| | | | | |
|---|---|---|---|---|
| 2,560,249 | A * | 7/1951 | Risch | 206/586 |
| 3,302,782 | A * | 2/1967 | Pezely, Jr. | 206/453 |
| 3,482,759 | A * | 12/1969 | Ortiz | 206/586 |
| 3,701,465 | A * | 10/1972 | Richter | 206/521 |
| 3,836,043 | A * | 9/1974 | Levin | 206/504 |
| 6,382,422 | B1 * | 5/2002 | Bocek | 206/586 |
| 6,666,334 | B2 * | 12/2003 | Fujii | 206/586 |
| 6,976,587 | B2 * | 12/2005 | Liverman et al. | 206/586 |

* cited by examiner

*Primary Examiner*—Dene Quest
(74) *Attorney, Agent, or Firm*—David N. Lathrop

(57) ABSTRACT

In a packaging cushion device, a base member has a base wall, and first and second sidewalls respectively perpendicular to two adjacent edges of the base wall. The base wall and first and second sidewalls define a receiving portion. A modular component has a base panel, two adjacent first and second side panels perpendicular to the base panel, a first projection extending from the first and second side panels, and a second projection extending from the base panel and the second panel. The first and second projections are matchable with and connectable to the receiving portion to form two interchangeable configurations of different heights, thereby satisfying the need of packing a computer housing in either folded or unfolded configuration, and saving packing materials.

13 Claims, 7 Drawing Sheets

PACKAGING CUSHION DEVICE HAVING MODULAR CUSHION UNITS

CROSS-REFERENCE TO RELATED APPLICATION

This application claims priority of Taiwanese Application No. 095131755 filed on Aug. 29, 2006.

BACKGROUND OF THE INVENTION

1. Field of the Invention

The invention relates to a packaging cushion device, more particularly to a packaging cushion device for the protection of corners of an article.

2. Description of the Related Art

Articles, for instance, electronic articles such as central processing unit, and displays, are vulnerable to damage when subjected to squeezing, pressing or impacting forces. In order to minimize damage caused to such articles during transport from a manufacturing end to a user end, cushioning materials, such as Styrofoam® and sponge, are utilized to space the articles from walls of packaging boxes, such as cardboard boxes and plastic boxes. As such, the articles will not hit against the packaging boxes, and a buffering effect can be produced when the packaging boxes are subjected to external forces. The function of protecting the article can therefore be achieved.

Generally, the shape and size of an article are fixed after the manufacture thereof is finished. Therefore, a cushioning material for packaging the article must have a structure and size that are fixed in accordance with the shape of the article. However, due to different needs in application, some products are designed to have configurations and sizes that can be varied from a manufacturing end to a final user end. In that case, the fixed-type cushioning materials are unable to accommodate different configurations of such products.

Take a computer device as an example. The hardware of a computer device includes a motherboard, electronic cards, a power source, etc., in addition to a computer housing. As a current way of commercializing computer devices, various component parts of computer devices may be offered by different manufacturers. Therefore, the computer device may be assembled by an upstream assembly factory, a wholesaler, or a retailer, and may also be assembled by the user himself/themselves. When a computer housing has not been assembled with other hardware, it is hollow. In order to reduce the volume of a computer housing prior to assembly with other hardware that will occupy space upon transport, there has been provided a computer housing with a modular or foldable design by which the computer housing can be laid flat, thereby decreasing the volume of the computer housing and reducing transportation costs. Because a computer device may be assembled by an upstream assembly factory or a retailer, during assembly of the computer device, the computer housing needs to be assembled or unfolded to form a space for containing other hardware, and after assembly of the computer device, the computer housing has to be packed once again so as to be transported to the end user. Therefore, the computer housing must undergo packaging two times when delivered from an original manufacturer to a place of assembly and then to the end user after assembly. If a cushioning device having an invariable shape is used for packaging such a foldable computer housing, it cannot accommodate both the folded and unfolded configurations of the foldable computer housing.

FIG. 1 shows a typical computer housing 91 associated with cushioning members 92, 93. The cushioning members 92, 93 are generally made of Styrofoam®, and are provided with structures matching the shapes of the front and rear sides 911, 912 of the computer housing 91 so as to cover corners at the front and rear sides 911, 912 and to protect the computer housing 91. However, the cushioning members 92, 93 having invariable shape cannot fit a folded flat configuration of a foldable computer housing.

As mentioned above, when an article has a variable configuration, a cushioning device having a fixed shape cannot satisfy packaging requirements for different configurations of the article.

SUMMARY OF THE INVENTION

Therefore, the object of the present invention is to provide a packaging cushion device formable into interchangeable modular configurations that provide differently sized receiving spaces.

According to the present invention, a packaging cushion device comprises at least one base member, and at least one modular component.

The base member has a base wall, a first sidewall, and a second sidewall. The base wall has first and second edges forming a corner therebetween. The first and second sidewalls are perpendicular to the base wall and are connected respectively to the first and second edges. The first and second sidewalls are spaced apart from the corner so as to define a first receiving corner portion therebetween.

The modular component has a bottom panel, a first side panel, a second side panel, a first projection, and a second projection. The bottom panel has first and second lateral ends forming a corner therebetween. The modular component has a reference point at a juncture between the first and second lateral ends, a first direction that extends perpendicularly away from the base panel from the reference point, and a second direction extending along the second lateral end and away from the first lateral end. The first and second side panels extend respectively from the first and second lateral ends along the first direction. Each of the first and second projections has a shape complementary to that of the receiving corner portion. The first projection extends along the first direction from apart of the first side panel and a part of the second side panel both of which are adjacent to the reference point. The second projection extends along the second direction from the second side panel and from an edge of a part of the base panel adjacent to the second side panel. A distance of a distal end of the first projection from the reference point along the first direction is different from a distance of a distal end of the second projection from the reference point along the second direction. A first modular configuration is formed when the first projection of the modular component is inserted into the receiving corner portion of the base member. A second modular configuration is formed when the second projection of the modular component is inserted into the receiving corner portion.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
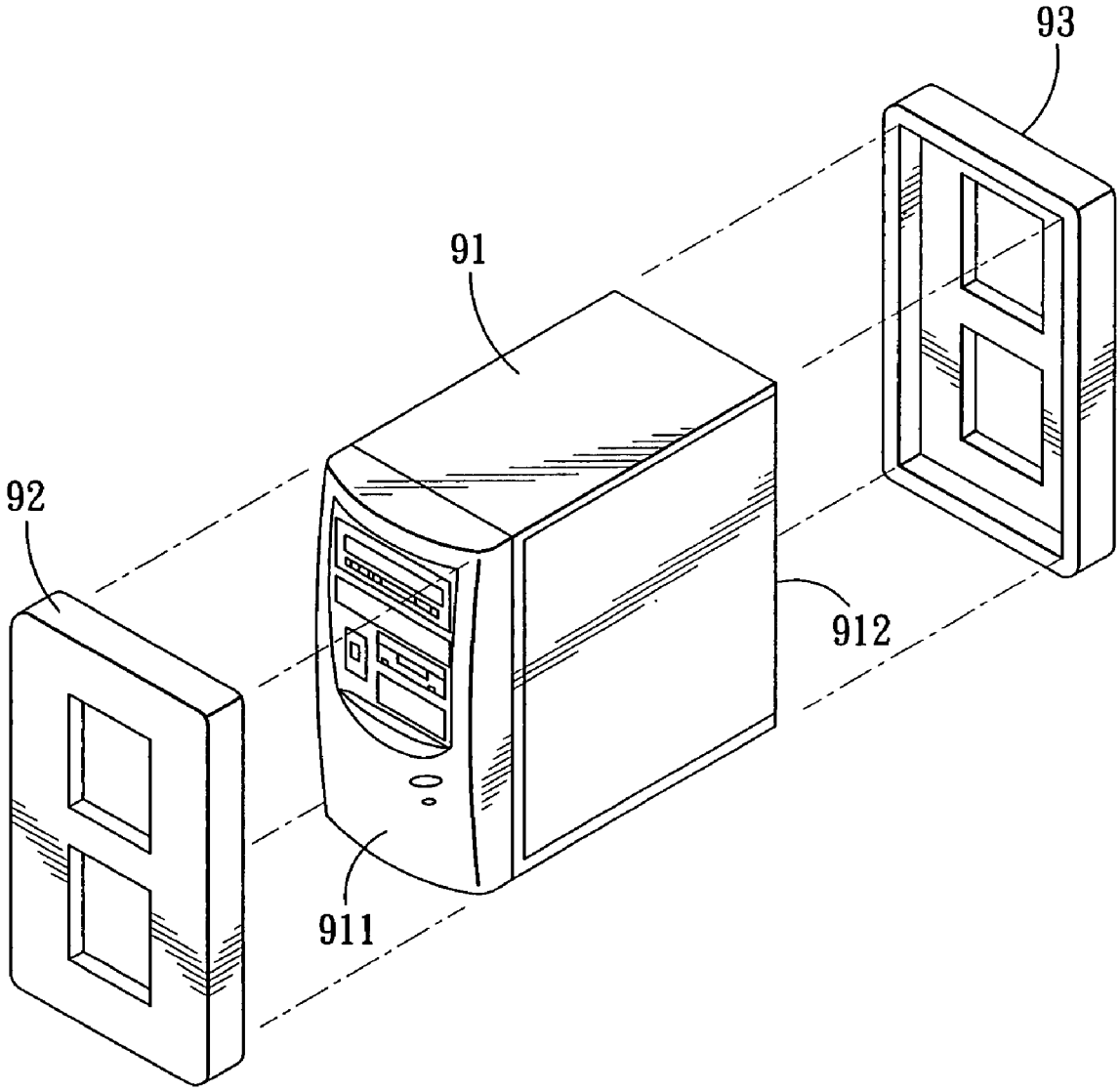
FIG. 1 PRIOR ART
FIG. 1 is a perspective view illustrating a conventional cushion device for packaging a computer housing.
Figure 2:
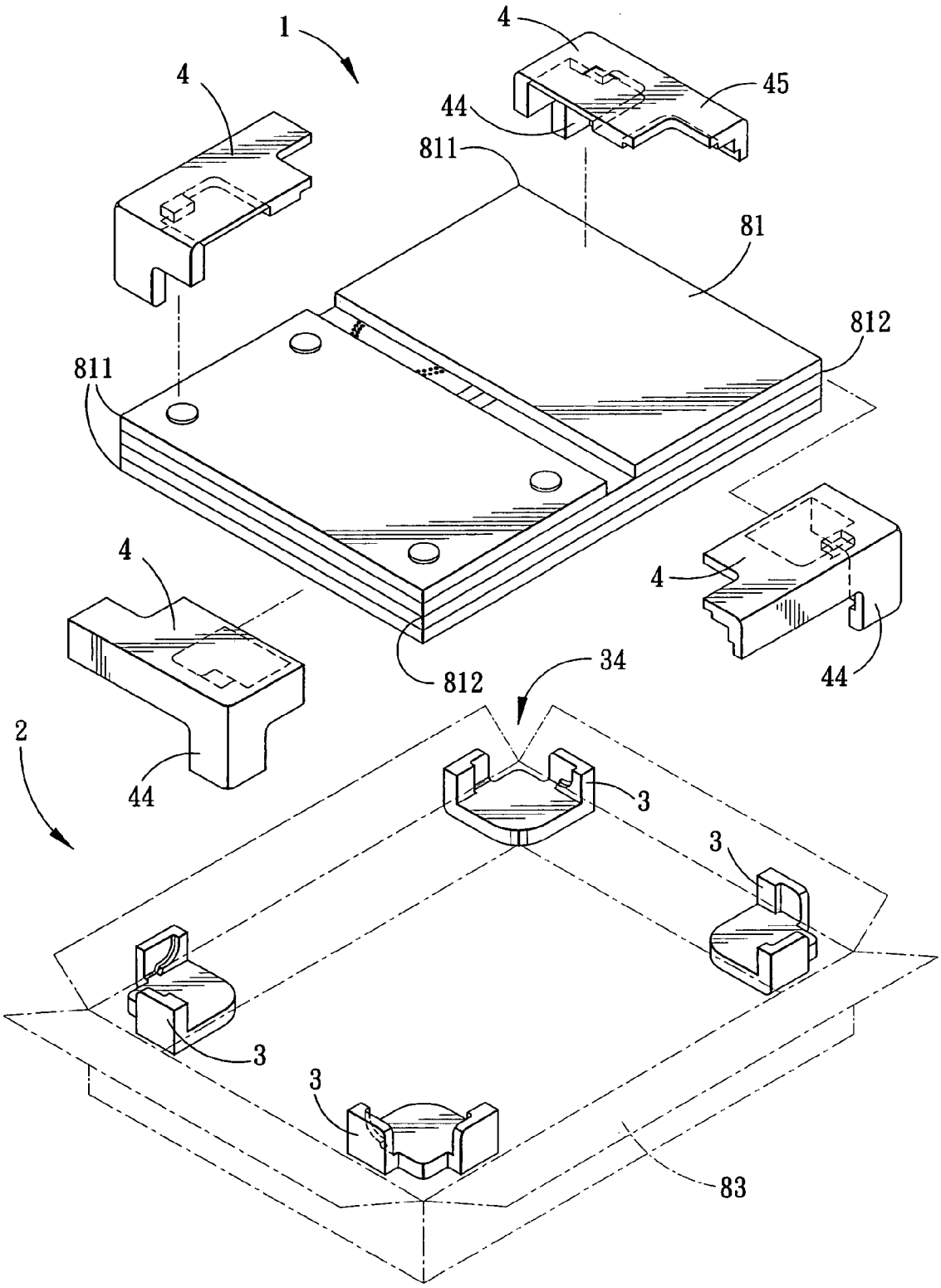
FIG. 2 is an exploded perspective view of the first preferred embodiment of a packaging cushion device according to the present invention for packaging the computer housing in a folded state.
Figure 3:
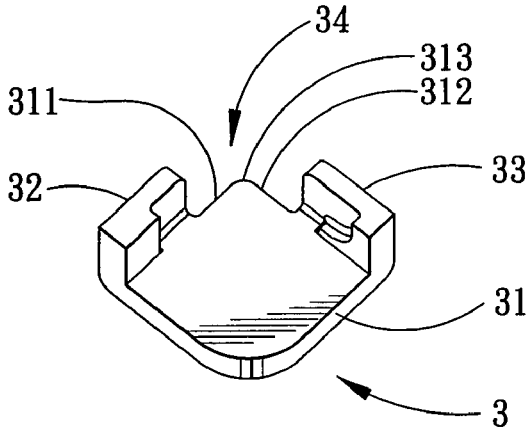
FIG. 3 is a perspective view showing a base member of the first preferred embodiment.

A preferred embodiment of the packaging cushion device according to the present invention is usable for packaging a housing of a computer device that can be folded and unfolded. Referring to FIG. 2, a packaging cushion device of the present invention is made from Styrofoam® and includes four sets of one-to-one assemblage cushion unit 2. Each cushion unit 2 includes a base member 3 and a modular component 4. As shown in FIG. 3, each base member 3 has a substantially rectangular base wall 31, and first and second sidewalls 32, 33 proximate to each other and extending perpendicularly from first and second edges 311, 312 of the base wall 31, respectively. The first and second edges 311, 312 of the base wall 31 form a right angle corner 313 therebetween. The first and second sidewalls 32, 33 are spaced apart from the right angle corner 313 by a predetermined distance so that a substantially L-shaped receiving corner portion 34 is defined therebetween.

Figure 4:
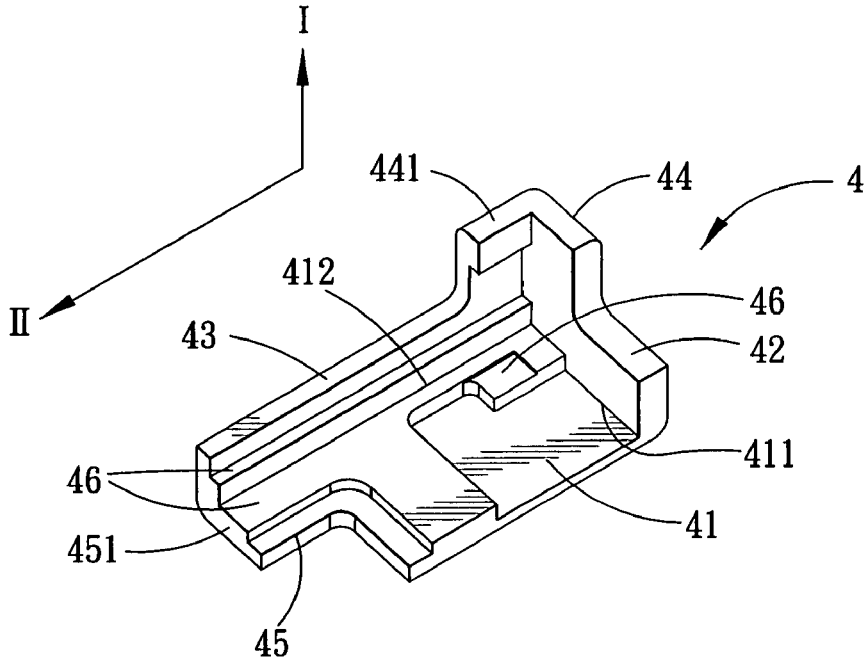
FIG. 4 is a perspective view showing a modular component of the first preferred embodiment.

As shown in FIG. 4, each modular component 4 has a bottom panel 41, a first side panel 42, a second side panel 43, a first projection 44, and a second projection 45. The bottom panel 41 has adjacent first and second lateral ends 411, 412 forming a corner therebetween. A juncture between the first and second side panels 411, 412 is defined as a reference point. A direction that extends perpendicularly from the reference point and away from the bottom panel 41 is defined as a first direction (I). Another direction that extends along the second side panel 412 and away from the first side panel 411 is defined as a second direction (II). The first and second side panels 42, 43 are formed to extend respectively from the first and second lateral ends 411, 412 in the first direction (I). Each of the first and second projections 44, 45 has a shape complementary to that of the receiving corner portion 34, and is to be assembled in the receiving corner portion 34. The first projection 44 extends along the first direction (I) from a part of the first side panel 42 and a part of the second side panel 43 adjacent to the reference point. The second projection 45 extends in the second direction (II) from the second side panel 43 and a part of the bottom panel 41. A distance of a distal end 441 of the first projection 44 from the reference point along the first direction (I) is smaller than a distance of a distal end 451 of the second projection 45 from the reference point along the second direction (II) so that the modular component 4 and the base member 3 can be assembled together to form two selective modular configurations that provide receiving spaces with different heights.

Figure 5:
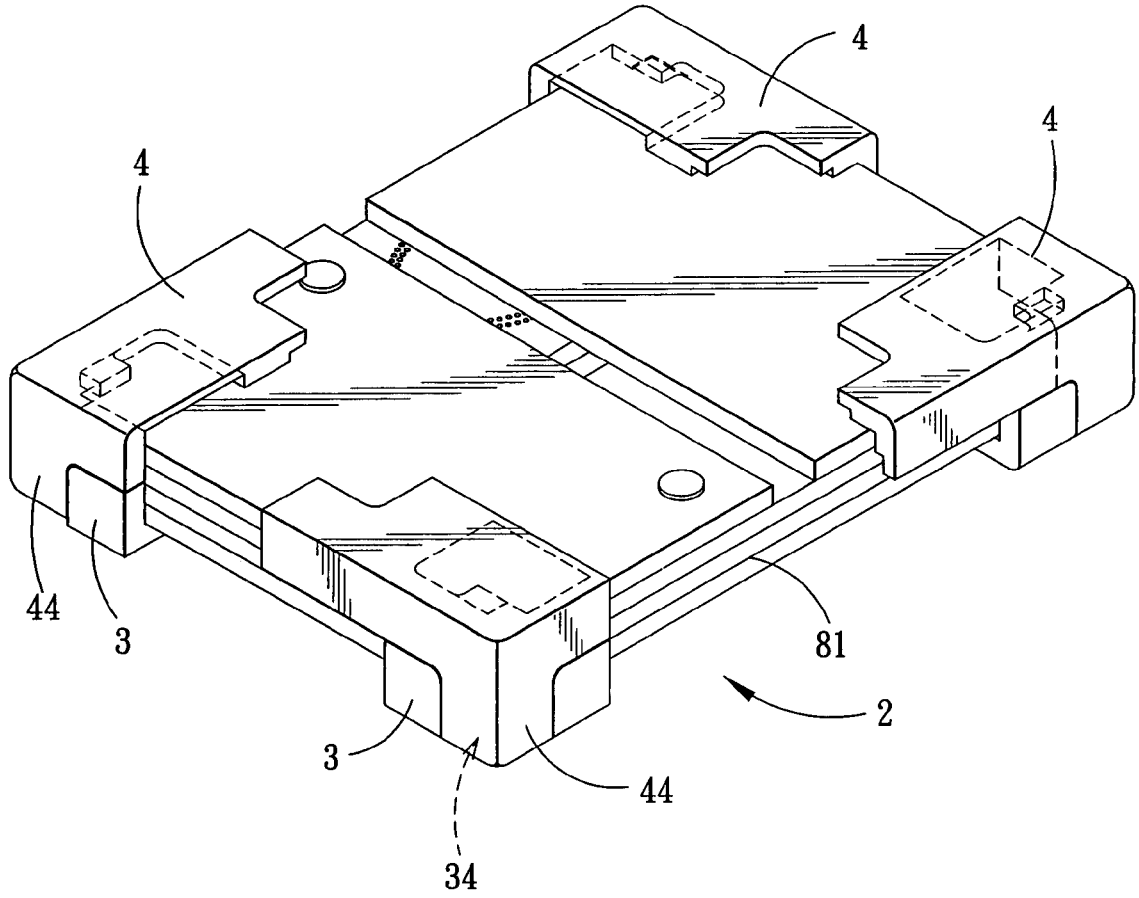
FIG. 5 shows an assembled state of the components of FIG. 2, wherein cushion units of the first preferred embodiment are in a first modular configuration, a box shown in FIG. 2 being omitted.

FIGS. 2 and 5 show a first modular configuration of the cushion units 2 which are used in packaging a lay-flat, folded computer housing 81. The procedure of packaging is as follows: Firstly, the base members 3 are positioned respectively at four corners of a bottom of a box 83. After the computer housing 81 is placed in the box 83, the first projection 44 of each modular component 4 is assembled in the receiving corner portion 34 of the respective base member 3. As a result, eight corner parts 811 at top and bottom of the computer housing 81 and four vertical edges 812 interconnecting adjacent top and bottom corner parts 811 are covered by the respective cushion units 2 to space the computer housing 81 from the walls of the box 83. Aside from achieving cushioning and protecting effects, the modular components 4 and the base members 3 which are interlocked provide a support to reinforce the structure of the box 83.

Figure 6:
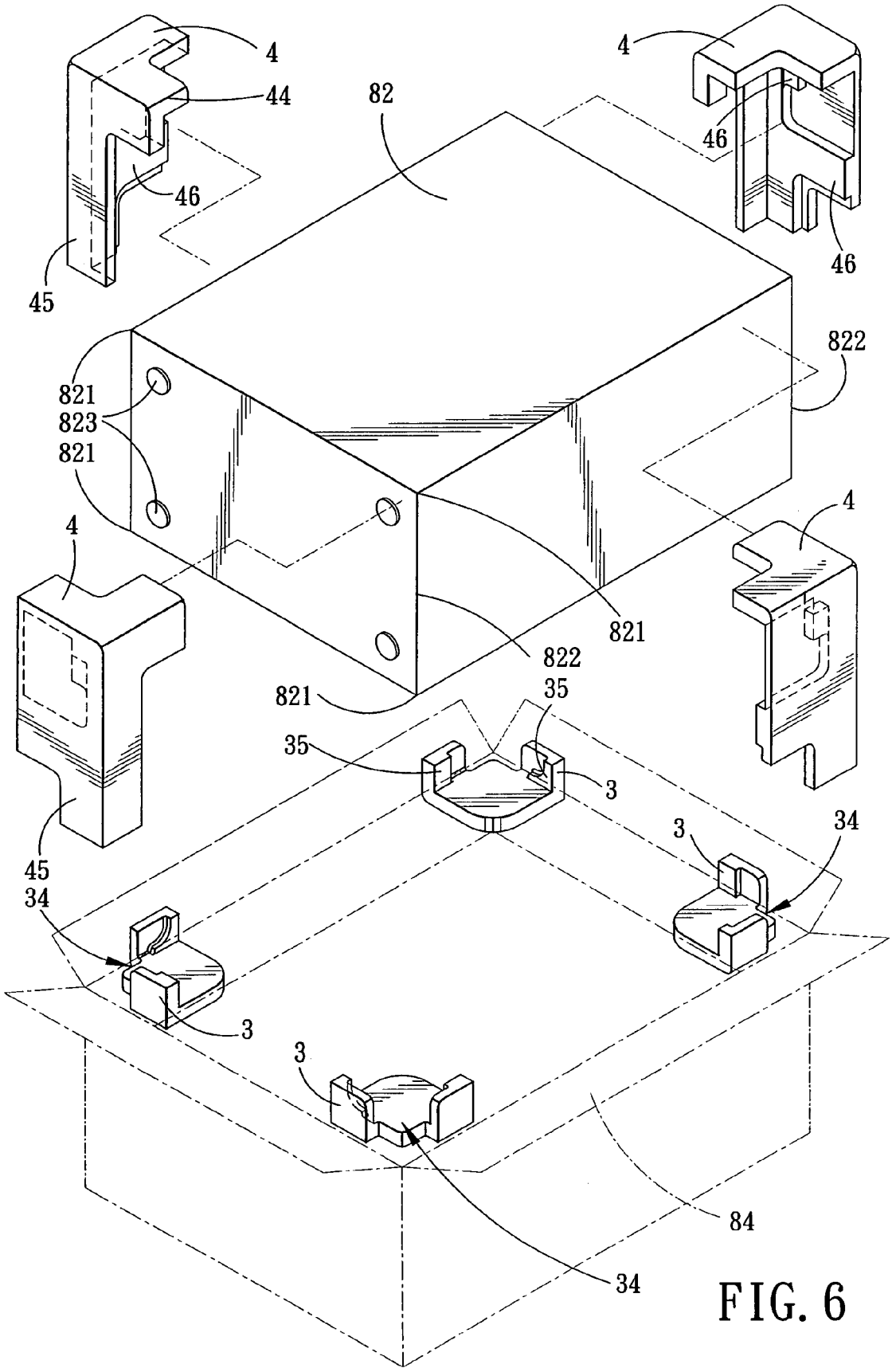
FIG. 6 is an exploded perspective view showing that the first preferred embodiment is used in packaging the computer housing in an unfolded state.
Figure 7:
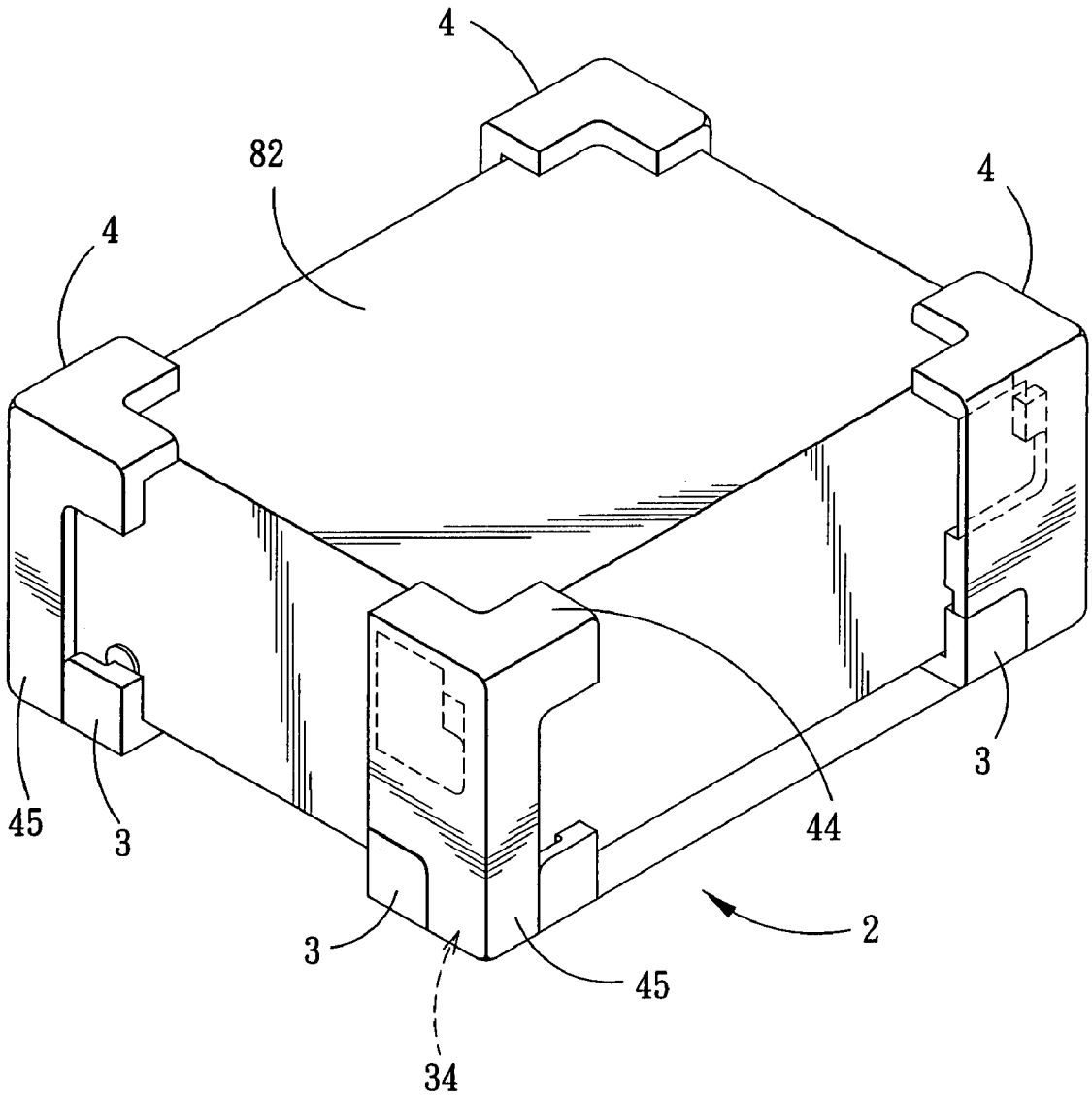
FIG. 7 shows an assembled state of the components of FIG. 6, wherein cushion units of the first preferred embodiment are in a second modular configuration, a box shown in FIG. 6 being omitted.

FIGS. 6 and 7 show a second modular configuration of the cushion units 2 useful in packaging a computer housing 82 in an unfolded rectangular configuration. The packaging procedure is as follows: Firstly, the base members 3 are positioned respectively at four corners of the bottom of a box 84. After the computer housing 82 is placed in the box 84, the second projections 45 of the modular components 4 are assembled in the respective receiving corner portions 34 of the base members 3 so that eight corner parts 821 and four lateral edges 822 each interconnecting two adjacent top and bottom corner parts 821 are covered by the respective cushion units 2. Especially, as the first projections 44 of the modular components 4 provide prolonged length to cover edges of the computer housing 82, the protecting and cushioning effects are enhanced. In addition, the interlocking of the base members 3 with the respective modular components 4 provides a support to reinforce the structure of the box 84. On the other hand, inner side faces of the base members 3 and the modular components 4 which are in contact with the computer housing 82 are provided with a plurality of recessed and raised patterns 35, 46 that are matchable with the surfaces of the computer housing 82. For example, the recessed and raised patterns 35, 46 matchable with the surfaces of the computer housing 82 at positions corresponding to leg pads 823 can avoid interference between contact surfaces so that the base members 3 and the modular components 4 can abut tightly against the surface of the computer housing 82.

Figure 8:
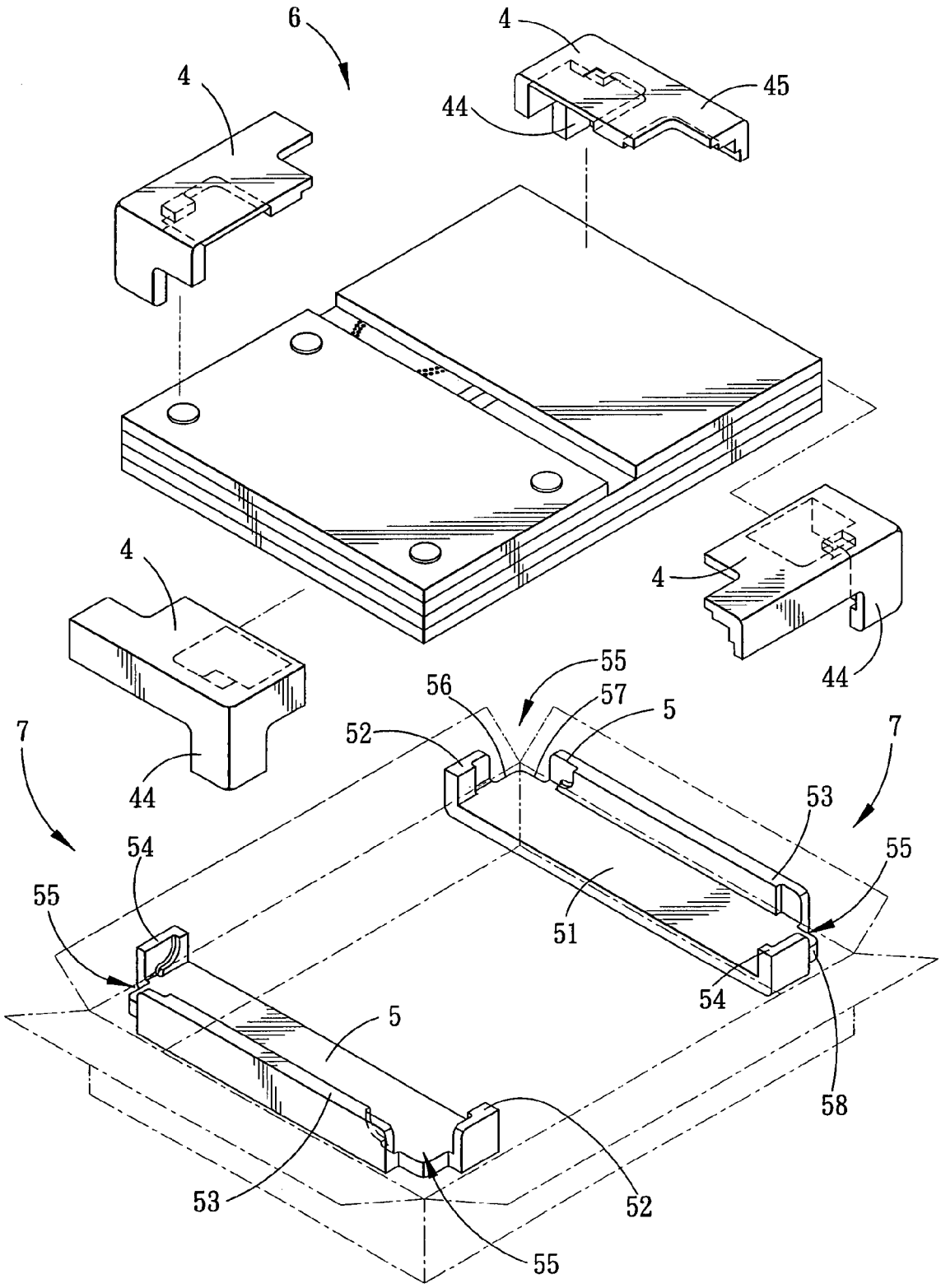
FIG. 8 is an exploded perspective view showing cushion units of the second preferred embodiment according to the present invention.

Referring to FIG. 8, there is shown the second preferred embodiment of a packaging cushion device 6 according to the present invention. The second preferred embodiment is substantially similar to the first preferred embodiment. The difference therebetween is that the base member 5 in the second preferred embodiment may be considered as one having two interconnected base members 3 of the first preferred embodiment (see FIG. 2). In particular, the base member 5 includes the base wall 51, the first sidewall 52, the second sidewall 53, a third sidewall 54, and first and second receiving corner portions 55 defined by the first, second and third sidewalls 52, 53, 54. The second sidewall 53 is longer than the first and third sidewalls 52, 54. The base wall 51 has first and second edges 56, 57 forming a corner therebetween, and a third edge 58 forming another corner with the second edge 57 opposite to the first edge 56. The first and second sidewalls 52, 53 are connected respectively to the first and second edges 56, 57 and are spaced apart from the corner thereof so that the first receiving corner portion 55 is defined therebetween. The third sidewall 54 is connected to the third edge 58 and opposite to the first sidewall 52. The third and second sidewalls 54, 53 are spaced from the aforesaid another corner so that the second receiving corner portion 55 is defined therebetween. Thus, the first and second receiving corner portions 55 are formed at two longitudinally opposed ends of the second side wall 53 to receive respectively the first projections 44 or the second projections 45 of two modular components 4.

Therefore, the packaging cushion device 6 according to the present invention includes two sets of one-to-two assemblage cushion units 7 each has one base member 5 and two modular components 4. Since the method of assembly in the second preferred embodiment is similar to that in the first preferred embodiment, it is not detailed herein.

In sum, due to the changeable modular configuration of the base members and the modular components of the cushion units, the packaging cushion device according to the present invention can satisfy the packaging requirements of the foldable computer housing in either folded or unfolded configuration. In addition, the present invention reduces consumption of packaging materials, facilitates configurational changes, effectively reduces shocks caused to the computer housing during transport, and provides better protecting and shock-absorbing effects.

While the present invention has been described in connection with what are considered the most practical and preferred embodiments, it is understood that this invention is not limited to the disclosed embodiment but is intended to cover various arrangement included within the spirit and scope of the broadest interpretation so as to encompass all such modifications and equivalent arrangements.

We claim:

1. A packaging cushion device comprising:

at least one base member having a base wall, a first sidewall, and a second sidewall, said base wall having first and second edges forming a corner therebetween, said first and second sidewalls being perpendicular to said base wall and connected respectively to said first and second edges, said first and second sidewalls being spaced apart from said corner so as to define a first receiving corner portion therebetween; and at least one modular component having a bottom panel, a first side panel, a second side panel, a first projection, and a second projection, said bottom panel having first and second lateral ends forming a corner therebetween, said modular component having a reference point at a juncture between said first and second lateral ends, a first direction that extends perpendicularly away from said base panel from said reference point, and a second direction extending along said second lateral end and away from said first lateral end, said first and second side panels extending respectively from said first and second lateral ends along said first direction, said first and second projections having a shape complementary to that of said receiving corner portion, said first projection extending along said first direction from a part of said first side panel and a part of said second side panel, both of said parts being adjacent to said reference point, said second projection extending along said second direction from said second side panel and an edge of a part of said base panel adjacent to said second side panel, a distance of a distal end of said first projection from said reference point along said first direction being different from a distance of a distal end of said second projection from said reference point along said second direction, wherein a first modular configuration is formed when said first projection of said modular component is inserted into said receiving corner portion of said base member, and a second modular configuration is formed when said second projection of said modular component is inserted into said receiving corner portion.

2. The packing cushion device as claimed in claim 1, wherein the distance of a distal end of said first projection from said reference point along said first direction is smaller than the distance of a distal end of said second projection from said reference point along said second direction.

3. The packaging cushion device as claimed in claim 1, which comprises a pair of said modular components, said base member further having a third edge forming another corner with said second edge opposite to said first edge, a third sidewall connected to said third edge and opposite to said first sidewall, said third sidewall being spaced apart from said another corner to define a second receiving corner portion with said second sidewall, said first and second receiving corner portions of said base member receiving respectively said first projections or said second projections of said pair of modular components.

4. The packaging cushion device as claimed in claim 2, which comprises a pair of said modular components, said base member further having a third edge forming another corner with said second edge opposite to said first edge, a third sidewall connected to said third edge and opposite to said first sidewall, said third sidewall being spaced apart from said another corner to define a second receiving corner portion with said second sidewall, said first and second receiving corner portions of said base member receiving respectively said first projections or said second projections of said pair of modular components.

5. The packaging cushion device as claimed in claim 3, wherein said second sidewall of said base wall has a length longer than those of said first and third sidewalls, said first and second receiving corner portions being disposed at two longitudinally opposed ends of said second sidewall.

6. The packaging cushion device as claimed in claim 4, wherein said second sidewall of said base wall has a length larger than that of said first and third sidewalls, said first and second receiving corner portions being disposed at two longitudinally opposed ends of said second sidewall.

7. A packaging cushion device to be disposed inside a box for packaging a foldable housing, the housing having a folded configuration and an unfolded configuration, and being formable into rectangular bodies having different heights, said packaging cushion device comprising:

four base members each having a base wall, a first sidewall, and a second sidewall, said base wall having first and second edges forming a corner therebetween, said first and second sidewalls being perpendicular to said base wall and connected respectively to said first and second edges, said first and second sidewalls being spaced apart from said corner to define a receiving corner portion therebetween; and four modular components each having a base panel, a first side panel, a second side panel, a first projection, and a second projection, said base panel having first and second lateral ends forming a corner therebetween, each of said modular components defining a reference point at a juncture between said first and second lateral ends, a first direction that extends perpendicularly away from said base panel and from said reference point, and a second direction extending along said second lateral end and away from said first lateral end, said first and second side panels extending respectively from said first and second lateral ends along said first direction, each of said first and second projections having a shape complementary to that of said receiving corner portion of a respective one of said base members, said first projection extending along said first direction from a part of said first side panel and a part of said second side panel both of which are adjacent to said reference point, said second projection extending along said second direction from said second side panel and an edge of a part of said base panel adjacent to said second side panel, wherein each of said base members may be assembled with one of said modular components to form a first modular configuration adapted for packing the housing in the folded configuration and to cover respectively four sets of corners of the housing, each of said sets having two adjacent top and bottom corners of the housing, and wherein each of said base members may be assembled with one of said modular components to form a second modular configuration adapted for packing the housing in the unfolded configuration and to cover respectively the four sets of corners of the housing.

8. The packing cushion device as claimed in claim 7, wherein said base members and said modular components have side faces adapted to contact the housing and formed with recessed and raised patterns, said recessed and raised patterns being matchable with surfaces of the housing.

9. The packaging cushion device of claim 7, wherein the distance of a distal end of said first projection from said reference point along said first direction is smaller than the distance of a distal end of said second projection from said reference point along said second direction.

10. A packaging cushion device to be disposed inside a box for packaging a foldable housing, the housing having a folded configuration and an unfolded configuration, and being formable into rectangular bodies having different heights, said packaging cushion device comprising:

two base members each having a base wall, a first sidewall, a second sidewall, and a third sidewall, said base wall having first and second edges forming a corner therebetween, and a third edge forming another corner with said second edge oppositely of said first edge, said first, second and third sidewalls being perpendicular to said base wall and connected respectively to said first, second and third edges, said first and second sidewalls being spaced apart from said corner to define a first receiving corner portion therebetween, said third and second sidewalls being spaced apart from said another corner to define a second receiving corner portion therebetween, said second sidewalls being longer than said first and third sidewalls;

four modular components each having a base panel, a first side panel, a second side panel, a first projection, and a second projection, said base panel having first and second lateral ends forming a corner therebetween, each of said modular components defining a reference point at a juncture between said first and second lateral ends, a first direction that extends perpendicularly away from said base panel and from said reference point, and a second direction extending along said second lateral end and away from said first lateral end, said first and second side panels extending respectively from said first and second lateral ends along said first direction, each of said first and second projections having a shape complementary to that of said first or second receiving corner portion, said first projection extending along said first direction from a part of said first side panel and a part of said second side panel both of which are adjacent to said reference point, said second projection extending along said second direction from said second side panel and an edge of a part of said base panel adjacent to said second side panel;

said first and second receiving corner portions of each of said base members receiving respectively said first projections or said second projections of two of said modular components;

wherein each of said base members may be assembled with two of said modular components to form a first modular configuration adapted for packing the housing in the folded configuration and to cover two of four sets of corners of the housing, each set having two adjacent top and bottom corners of the housing; and wherein each of said base members may be assembled with two of said modular components to form a second modular configuration adapted for packing the housing in the unfolded configuration and to cover two of the four sets of corners of the housing.

11. The packing cushion device as claimed in claim 10, wherein said base members and said modular components have side faces adapted to contact the housing and formed with recessed and raised patterns, said recessed and raised patterns being matchable with surfaces of the housing.

12. The packaging cushion device of claim 10, wherein the distance of a distal end of said first projection from said reference point along said first direction is smaller than the distance of a distal end of said second projection from said reference point along said second direction.

13. The packaging cushion device as claimed in claim 10, wherein said second sidewall of said base wall has a length larger than those of said first and third sidewalls, said first and second receiving corner portions being disposed at two longitudinally opposed ends of said second sidewall.

* * * * *